US011802701B2

(12) United States Patent
Kadowaki

(10) Patent No.: US 11,802,701 B2
(45) Date of Patent: Oct. 31, 2023

(54) AIR-CONDITIONING APPARATUS

(71) Applicant: Mitsubishi Electric Corporation, Tokyo (JP)

(72) Inventor: Kimitaka Kadowaki, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 214 days.

(21) Appl. No.: 17/260,307

(22) PCT Filed: Sep. 21, 2018

(86) PCT No.: PCT/JP2018/034974
§ 371 (c)(1),
(2) Date: Jan. 14, 2021

(87) PCT Pub. No.: WO2020/059105
PCT Pub. Date: Mar. 26, 2020

(65) Prior Publication Data

US 2021/0285673 A1 Sep. 16, 2021

(51) Int. Cl.
*F24F 11/36* (2018.01)
*F24F 1/0007* (2019.01)
(Continued)

(52) U.S. Cl.
CPC ..... *F24F 11/36* (2018.01); *F24F 1/0007* (2013.01); *F24F 1/32* (2013.01); *F24F 11/58* (2018.01); *F24F 11/85* (2018.01)

(58) Field of Classification Search
CPC ..... F24F 11/89; F24F 11/00; F24F 11/526; F24F 11/52; F24F 11/36
See application file for complete search history.

(56) References Cited

U.S. PATENT DOCUMENTS 9,459,033 B2 * 10/2016 Tamaki ..... F25B 49/005
10,269,235 B2 * 4/2019 Dayalan ..... G08B 25/10
(Continued)

FOREIGN PATENT DOCUMENTS

JP 2001-336810 A 12/2001
JP 2008-196740 A 8/2008
(Continued)

OTHER PUBLICATIONS

International Search Report of the International Searching Authority dated Nov. 27, 2018 for the corresponding International application No. PCT/JP2018/034974 (and English translation).

*Primary Examiner* — Nelson J Nieves
*Assistant Examiner* — Meraj A Shaikh
(74) *Attorney, Agent, or Firm* — POSZ LAW GROUP, PLC

(57) ABSTRACT

An air-conditioning apparatus includes: an outdoor unit including a compressor that compresses and discharges refrigerant to a refrigerant circuit; an indoor unit including a load-side heat exchanger that causes heat exchange to be performed between air in an air-conditioned space and a heat medium subjected to heat exchange with the refrigerant; a flow rate detection unit that detects a flow rate of the heat medium; and an alarm unit provided in the indoor unit. The alarm unit includes a determination unit and an abnormality alarm unit. The determination unit determines whether an abnormality occurs in the indoor unit or not based on the flow rate detected by the flow rate detection unit. The abnormality alarm unit outputs an alarm when the determination unit determines that the abnormality occurs in the indoor unit.

11 Claims, 11 Drawing Sheets

(51) Int. Cl.

| | |
|---|---|
| ***F24F 1/32*** | (2011.01) |
| ***F24F 11/58*** | (2018.01) |
| ***F24F 11/85*** | (2018.01) |

(56) References Cited

U.S. PATENT DOCUMENTS

| | | | | |
|---|---|---|---|---|
| 2012/0019674 | A1* | 1/2012 | Ohnishi | G08C 17/00 348/207.1 |
| 2013/0305758 | A1* | 11/2013 | Matsui | F25B 49/02 62/129 |
| 2015/0339635 | A1* | 11/2015 | Washiro | G06Q 10/20 705/305 |
| 2016/0209060 | A1* | 7/2016 | Castillo | F24F 11/62 |
| 2016/0245539 | A1 | 8/2016 | Motomura et al. | |
| 2016/0284073 | A1* | 9/2016 | Michalscheck | G05B 23/0216 |
| 2017/0180147 | A1* | 6/2017 | Brandman | G08B 21/20 |
| 2017/0292725 | A1* | 10/2017 | Conley | F24F 11/39 |
| 2018/0058712 | A1 | 3/2018 | Miyaura | |

FOREIGN PATENT DOCUMENTS

| | | | |
|---|---|---|---|
| JP | 2017-101855 | A | 6/2017 |
| WO | 2015/092896 | A1 | 6/2015 |
| WO | 2016/162952 | A1 | 10/2016 |

* cited by examiner

AIR-CONDITIONING APPARATUS

CROSS REFERENCE TO RELATED APPLICATION

This application is a U.S. national stage application of PCT/JP2018/034974 filed on Sep. 21, 2018, the contents of which are incorporated herein by reference.

TECHNICAL FIELD

The present disclosure relates to an air-conditioning apparatus that circulates a heat medium to perform air conditioning.

BACKGROUND ART

As an existing air-conditioning apparatus, an air-conditioning apparatus is known that includes an outdoor unit, an indoor unit, and a relay unit provided between the outdoor unit and the indoor unit (see, for example, Patent Literature 1). The air-conditioning apparatus disclosed in Patent Literature 1 includes a cycle circuit in which refrigerant circulates between an outdoor unit and a relay unit and a heat-medium cycle circuit in which a heat medium circulates between the relay unit and the indoor unit. In the relay unit, the heat medium exchanges heat with the refrigerant that circulates in the refrigerant circuit, and in the indoor unit, the heat medium exchanges heat with air in an indoor space. The heat medium supplies heating energy or cooling energy into the indoor space, whereby air in the indoor space is conditioned.

CITATION LIST

Patent Literature

Patent Literature 1: Japanese Unexamined Patent Application Publication No. 2017-101855

SUMMARY OF INVENTION

Technical Problem

In the air-conditioning apparatus disclosed in Patent Literature 1, an alarm is not output even when an abnormality occurs in the indoor unit. Therefore, there is a risk that the air-conditioning apparatus will continues to operate while the indoor unit has the abnormality.

The present disclosure is applied to solve the above problem, and relates to an air-conditioning apparatus that outputs an alarm when an abnormality occurs in an indoor unit that performs air conditioning with heat supplied from a heat medium.

Solution to Problem

An air-conditioning apparatus according to an embodiment of the present disclosure air-conditioning apparatus includes: an outdoor unit including a compressor that compresses and discharges refrigerant to a refrigerant circuit; an indoor unit including a load-side heat exchanger that causes heat exchange to be performed between air in an air-conditioned space and a heat medium subjected to heat exchange with the refrigerant; a flow rate detection unit that detects a flow rate of the heat medium; and an alarm unit provided in the indoor unit. The alarm unit includes a determination unit and an abnormality alarm unit. The determination unit determines whether an abnormality occurs in the indoor unit or not based on the flow rate detected by the flow rate detection unit. The abnormality alarm unit outputs an alarm when the determination unit determines that the abnormality occurs in the indoor unit.

Advantageous Effects of Invention

According to the embodiment of the present disclosure, the alarm unit is provided to determine whether an abnormality occurs in the indoor unit or not based on the flow rate of a heat medium, and to output an alarm when determining that an abnormality occurs in the indoor unit. Therefore, a user can know the occurrence of the abnormality in the indoor unit, and thus can deal with the abnormality, to thereby prevent the air-conditioning apparatus from continuing to operate while the indoor unit has the abnormality.

DESCRIPTION OF EMBODIMENTS

Embodiment 1

Figure 1:
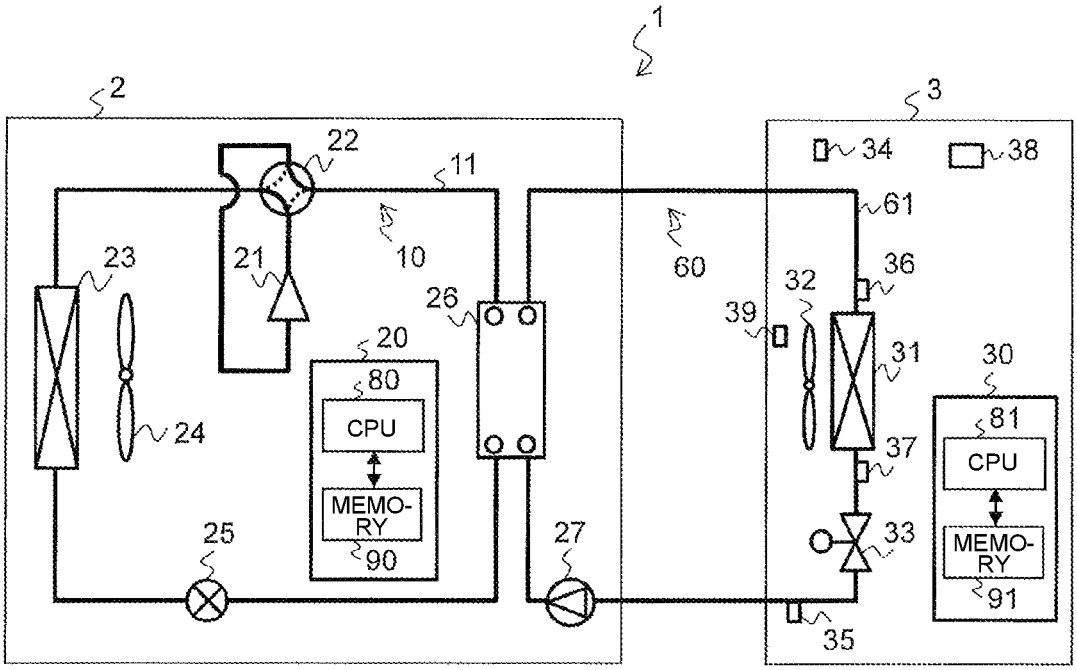
FIG. 1 is a diagram illustrating an example of the configuration of an air-conditioning apparatus according to Embodiment 1 of the present disclosure.

The configuration of an air-conditioning apparatus of Embodiment 1 will be described. FIG. 1 is a diagram illustrating an example of the configuration of the air-conditioning apparatus according to Embodiment 1 of the present disclosure. An air-conditioning apparatus 1 includes an outdoor unit 2 and an indoor unit 3. The outdoor unit 2 causes a heat medium, which does not change in phase, to circulate between the outdoor unit 2 and the indoor unit 3. The heat medium that does not change in phase is, for example, water or brine. Although Embodiment 1 will be described with respect to the case where a single outdoor unit 2 and a single indoor unit 3 are provided, a plurality of outdoor units 2 and a plurality of indoor units 3 may be provided.

The outdoor unit 2 includes a compressor 21, a flow switching device 22, a heat-source-side heat exchanger 23, a heat-medium heat exchanger 26, and an expansion device 25. The compressor 21 compresses and discharges refrigerant. The flow switching device 22 switches the flow direction of the refrigerant. The heat-source-side heat exchanger 23 causes heat exchange to be performed between the refrigerant and outside air. The heat-medium heat exchanger 26 causes heat exchange between the refrigerant and the heat medium. The expansion device 25 reduce the pressure of the refrigerant to expand the refrigerant. The outdoor unit 2 also includes a heat-source-side fan 24 and a controller 20. The heat-source-side fan 24 supplies outside air to the heat-source-side heat exchanger 23. The controller 20 controls the operation of the air-conditioning apparatus 1. Furthermore, a pump 27 is provided in the outdoor unit 2. The pump 27 causes the heat medium to circulate between the outdoor unit 2 and the indoor unit 3.

The indoor unit 3 includes a load-side heat exchanger 31, a load-side fan 32, a flow control device 33, and an alarm unit 30. The load-side heat exchanger 31 causes heat exchange to be performed the heat medium and air in an indoor space. The load-side fan 32 sucks air in the indoor space, and supplies the air in the indoor space to the load-side heat exchanger 31. The flow control device 33 controls the flow rate of the heat medium. The indoor unit 3 is provided with a room temperature sensor 34 and a suction temperature sensor 39. The room temperature sensor 34 detects a room temperature Tr that is the temperature of air in the indoor space that is an air-conditioned space. The suction temperature sensor 39 detects a suction temperature Tw that is the temperature of air that is sucked into the indoor unit 3. The indoor unit 3 is provided with a communication unit 38 that communicates with a remote control unit not illustrated.

At a heat medium pipe 61 of the indoor unit 3, a flow rate detection unit 35 that detects a flow rate FL of the heat medium is provided. The flow rate detection unit 35 may be a flowmeter, for example. An inlet temperature sensor 36 that detects a temperature Tin of the heat medium is provided at part of the heat medium pipe 61 that is close to a heat medium inlet side of the load-side heat exchanger 31. An outlet temperature sensor 37 that detects a temperature Tout of the heat medium is provided at part of the heat medium pipe 61 that is close to the heat medium outlet side of the load-side heat exchanger 31.

The compressor 21 is, for example, an inverter compressor whose capacity can be controlled. The flow switching device 22 switches the flow passage for the refrigerant, for example, between the flow passage for use in a heating operation and that for use in a cooling operation. The flow switching device 22 is, for example, a four-way valve. The expansion device 25 is a device whose opening degree can be changed to a desired opening degree to control the flow rate of the refrigerant. The expansion device 25 is, for example, an electronic expansion valve. The heat-source-side heat exchanger 23 and the load-side heat exchanger 31 are, for example, fin-and-tube type heat exchangers.

The compressor 21, the heat-source-side heat exchanger 23, the expansion device 25, and the heat-medium heat exchanger 26 are connected by refrigerant pipes 11, thereby forming a refrigerant circuit 10 in which refrigerant circulates. The heat-medium heat exchanger 26, the load-side heat exchanger 31, and the pump 27 are connected by heat medium pipes 61, thereby forming a heat medium circuit 60 in which the heat medium circulates.

Figure 2:
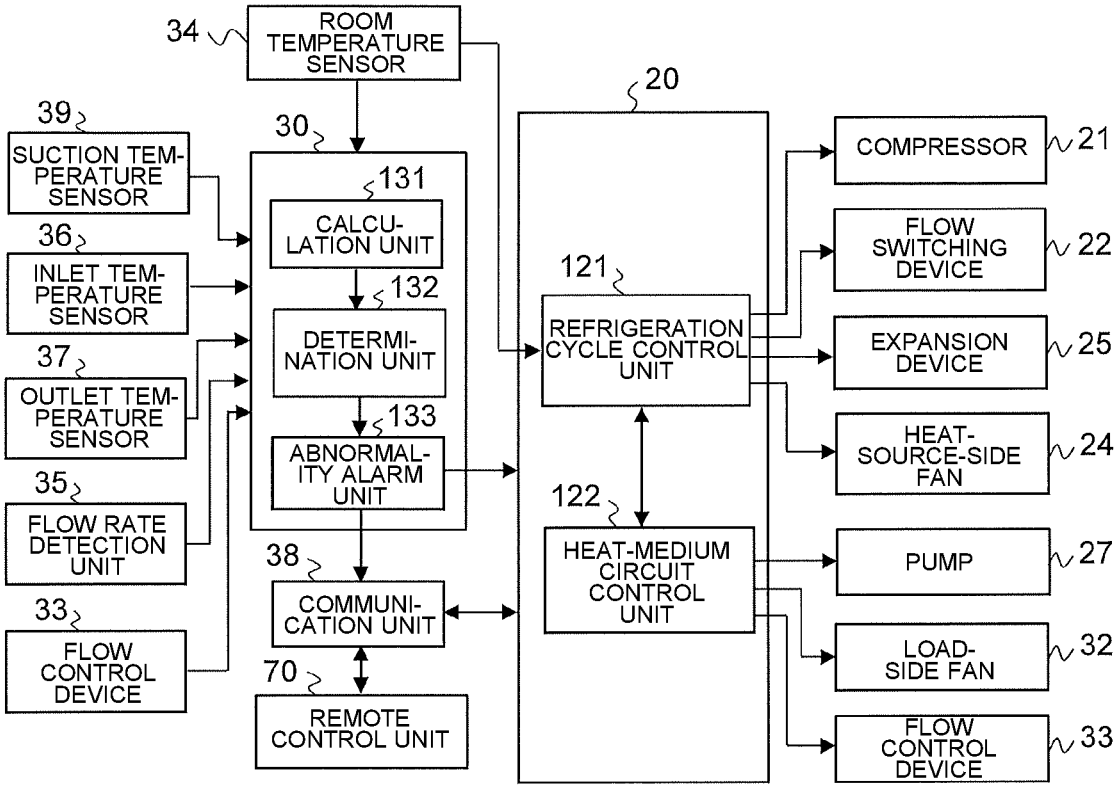
FIG. 2 is a diagram illustrating a configuration related to control of the air-conditioning apparatus as illustrated in FIG. 1.

FIG. 2 is a diagram illustrating a configuration related to control of the air-conditioning apparatus as illustrated in FIG. 1. As illustrated in FIG. 1, the controller 20 includes a memory 90 that stores a program, and a central processing unit (CPU) 80 that executes the program. As illustrated in FIG. 2, to the controller 20, a detected value is input from the room temperature sensor 34. The controller 20 receives an instruction signal from a remote control unit 70 via the communication unit 38, the instruction signal including content that is input by a user using the remote control unit 70. The controller 20 controls the air-conditioning apparatus 1 based on the contents of an alarm given from the alarm unit 30.

The controller 20 includes a refrigeration cycle control unit 121 and a heat-medium circuit control unit 122. The refrigeration cycle control unit 121 controls the flow switching device 22 in accordance with which operation mode is set. The refrigeration cycle control unit 121 controls the refrigeration cycle of the refrigerant that circulates in the refrigerant circuit 10 such that a detected value obtained by the room temperature sensor 34 approaches a set temperature Ts. To be more specific, the refrigeration cycle control unit 121 controls the operating frequency of the compressor 21 and the opening degree of the expansion device 25. The refrigeration cycle control unit 121 also transmits a control signal to the heat-medium circuit control unit 122, the control signal including control content such as control of the rotation speed of the pump 27. For example, the refrigeration cycle control unit 121 adjusts the rotation speed of the pump 27 based on the temperature difference between the set temperature Ts and the room temperature Tr. The heat-medium circuit control unit 122 controls the rotation speed of the pump 27, the operating frequency of the load-side fan 32, and the opening degree of the flow control device 33 based on the control signal received from the refrigeration cycle control unit 121. The set temperature Ts is set by a user who uses the indoor unit 3, using the remote control unit 70, for example.

As illustrated in FIG. 1, the alarm unit 30 includes a memory 91 that stores a program, and a CPU 81 that executes the program. The memory 91 is a nonvolatile memory such as a flash memory. As illustrated in FIG. 2, to the alarm unit 30, detected values are input from the inlet temperature sensor 36, the outlet temperature sensor 37, and the flow rate detection unit 35. Also, to the alarm unit 30, detected values are input from the room temperature sensor 34 and the suction temperature sensor 39. Furthermore, to the alarm unit 30, a value of the opening degree of the flow control device 33 is input. The alarm unit 30 includes a calculation unit 131, a determination unit 132, and an abnormality alarm unit 133. The alarm unit 30 determines whether an abnormality occurs in the indoor unit 3 or not, for example, based on the flow rate FL, and also based on a heat-exchange amount difference Qd based on the flow rate FL.

First, the determination by the determination unit 132 based on the flow rate FL will be described. The calculation unit 131 calculates two thresholds, as references for the determination related to an abnormality in the indoor unit 3, based on a theoretical value of the flow rate that is determined from the opening degree of the flow control device 33. Alarms include two kinds of alarms that are a serious alarm and a mild alarm. Based on the theoretical value of the flow rate that is determined from the opening degree of the flow control device 33, the calculation unit 131 calculates a first flow rate threshold FLth1 and a second flow rate threshold FLth2. The first flow rate threshold FLth1 is a reference for the determination of whether a mild abnormality occurs or not regarding the flow rate FL. The second flow rate threshold FLth2 is a reference for the determination of whether a serious abnormality occurs or not regarding the flow rate FL. The second flow rate threshold FLth2 is a value less than the first flow rate threshold FLth1.

The determination unit 132 determines whether or not an abnormality occurs in the indoor unit 3 or not based on the flow rate FL detected by the flow rate detection unit 35. The determination unit 132 compares the flow rate FL with the first flow rate threshold FLth1 and with the second flow rate threshold FLth2. When the flow rate FL is less than the second flow rate threshold FLth2, the determination unit 132 determines that a serious abnormality occurs in the indoor unit 3. This is because when the flow rate FL is less than the second flow rate threshold FLth2, the indoor unit 3, the heat medium circuit 60, etc., can be considered to have a serious abnormality that causes interruption of the flow of the heat medium. When the flow rate FL is higher than or equal to the second flow rate threshold FLth2 and is less than or equal to the first flow rate threshold FLth1, the determination unit 132 determines that a mild abnormality occurs in the indoor unit 3. This is because when the flow rate FL is higher than or equal to the second flow rate threshold FLth2 and is less than the first flow rate threshold FLth1, it is conceivable that the flow rate of the heat medium is lower than that in a normal state, and the indoor unit 3, the heat medium circuit 60, etc. have a mild abnormality.

Of the two kinds of alarms, the serious alarm is an alarm indicating a high urgency in which the operation of the air-conditioning apparatus 1 needs to be immediately stopped. The mild alarm is an alarm indicating a low urgency in which the operation of the air-conditioning apparatus 1 does not need to be immediately stopped, and the air-conditioning apparatus 1 will leave an abnormal state if being subjected to maintenance. Regarding the flow rate FL, a serious abnormality can be considered caused by, for example, occurrence of a failure of the pump 27 or the damage of the heat medium pipe 61. In the case where the heat medium is water, if the heat medium pipe 61 is damaged, a water leak occurs at the heat medium pipe 61. Regarding the flow rate FL, a mild abnormality can be considered caused by, for example, deposition of a substance contained in the heat medium in the pipe.

The above description refers to the case where the calculation unit 131 calculates the two thresholds based on the theoretical value of the flow rate that is determined from the opening degree of the flow control device 33. However, in the case where the opening degree of the flow control device 33 is constant, the calculation unit 131 does not need to calculate the above two thresholds. It suffices that the memory 91 stores the first flow rate threshold FLth1 and the second flow rate threshold FLth2 that are obtained in the case where the opening degree of the flow control device 33 is a constant value.

Next, the determination by the determination unit 132 based on the heat-exchange amount difference Qd will be described. The determination unit 132 determines whether an abnormality occurs in the indoor unit 3 or not based on a refrigeration capacity of the load-side heat exchanger 31. The calculation unit 131 calculates an air heat exchange amount Qr and a heat-medium heat exchange amount Qw, and then calculates the heat-exchange amount difference Qd that is the difference between the air heat exchange amount Qr and the heat-medium heat exchange amount Qw.

The air heat exchange amount Qr is calculated by the following equation (1) based on the suction temperature Tw and the room temperature Tr. "K" in the equation (1) is a coefficient that is determined depending on the shape, physical properties, etc. of the indoor unit 3.

$$Qr=K\times(|Tw-Tr|) \tag{1}$$

Where Td is a temperature difference (|Tin−Tout|) between the temperature Tin and the temperature Tout, the heat-medium heat exchange amount Qw is calculated by, for example, the following equation (2). "C" in the equation (2) is a coefficient.

$$Qw=C\times FL\times Td \tag{2}$$

The calculation unit 131 calculates the air heat exchange amount Qr according to the equation (1), and calculates the heat-medium heat exchange amount Qw according to the equation (2). The calculation unit 131 then calculates, as the heat-exchange amount difference Qd, an absolute value of the difference between the air heat exchange amount Qr and the heat-medium heat exchange amount Qw. The determination unit 132 compares the calculated heat-exchange amount difference Qd with a first heat exchange threshold Qth1 and a second heat exchange threshold Qth2. The memory 91 stores the first heat exchange threshold Qth1 and the second heat exchange threshold Qth2, and the second heat exchange threshold Qth2 is a value greater than the first heat exchange threshold Qth1.

When the heat-exchange amount difference Qd is greater than the second heat exchange threshold Qth2, the determination unit 132 determines that a serious abnormality occurs in the indoor unit 3. This is because when the heat-exchange amount difference Qd is greater than the second heat exchange threshold Qth2, the load-side heat exchanger 31 can be considered to have a serious abnormality in which the heat medium cannot sufficiently exchange heat with air in an indoor space. When the heat-exchange amount difference Qd is less than or equal to the second heat exchange threshold Qth2 and is greater than the first heat exchange threshold Qth1, the determination unit 132 determines that the indoor unit 3 has a mild abnormality. This is because the heat-exchange amount difference Qd is less than or equal to the second heat exchange threshold Qth2 and is greater than the first heat exchange threshold Qth1, it can be considered that the heat exchange efficiency of the load-side heat exchanger 31 is lower than that in a normal state, and a mild abnormality occurs in the indoor unit 3, the heat medium circuit 60, etc.

Regarding the heat-exchange amount difference Qd, a serious abnormality can be considered to occur because of a failure of the load-side fan 32 or a serious deterioration of the load-side heat exchanger 31, for example. The serious deterioration of the load-side heat exchanger 31 means that the load-side heat exchanger 31 should be replaced by a new one as soon as possible, for example. Regarding the heat-exchange amount difference Qd, a mild abnormality can be considered to occur because of an excessively high room temperature Tr for the refrigeration capacity of the indoor unit 3, an excessively low room temperature Tr for the refrigeration capacity of the indoor unit 3, or contamination of the filter of the indoor unit 3. In the case where it is determined that a mild abnormality occurs, if the time that has elapsed from the time when the filter is cleaned or the filter is replaced by a new one is short, the room temperature Tr can be considered excessively high for the refrigeration capacity of the indoor unit 3, or the room temperature Tr can be considered excessively low for the refrigeration capacity of the indoor unit 3. The cause of the mild abnormality is not limited to the above causes. For example, also in the case where the load-side heat exchanger 31 deteriorates, when it is determined from the degree of the deterioration that the load-side heat exchanger 31 does not need to be immediately replaced by a new one, the deterioration of the load-side heat exchanger 31 corresponds to a mild abnormality.

When the determination unit 132 determines that an abnormality occurs in the indoor unit 3, the abnormality alarm unit 133 outputs an alarm to one or both of the remote control unit 70 and the controller 20. The alarm output from the abnormality alarm unit 133 is a signal including information indicating the kind of the alarm. Specifically, when the determination unit 132 determines that a serious abnormality occurs in the indoor unit 3, the abnormality alarm unit 133 outputs, to one or both of the remote control unit 70 and the controller 20, a serious alarm indicating that the level of the alarm is high. When the determination unit 132 determines that a mild abnormality occurs in the indoor unit 3, the abnormality alarm unit 133 outputs, to one or both of the remote control unit 70 and the controller 20, a mild alarm indicating that the level of the alarm is low. The alarms may have respective identification numbers in such a manner as to enable the remote control unit 70 and the controller 20 to distinguish the kinds of the alarms from the identification numbers. In this case, for example, regarding the flow rate FL, the identification number of the serious alarm is 1300, and the identification number of the mild alarm is 1500; and regarding the heat-exchange amount difference Qd, the identification number of the serious alarm is 400, and the identification number of the mild alarm is 1600.

Figure 3:
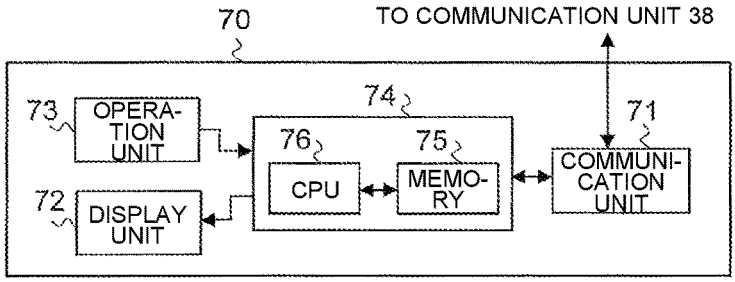
FIG. 3 is a block diagram illustrating an example of the configuration of a remote control unit illustrated in FIG. 2.

FIG. 3 is a block diagram illustrating an example of the configuration of the remote control unit as illustrated in FIG. 2. As illustrated in FIG. 3, the remote control unit 70 includes a communication unit 71, a display unit 72, an operation unit 73, and a control unit 74. The control unit 74 includes a memory 75 that stores a program, and a CPU 76 that executes a processing according to the program. When receiving an alarm from the alarm unit 30 via the communication unit 71, the control unit 74 causes the display unit 72 to indicate that the alarm is output. In this case, the control unit 74 may cause the display unit 72 to indicate not only that the alarm is output, but also the kind of the alarm.

The memory 75 may store alarms such that identification numbers of the alarms and the kinds of the alarms are associated with each other. For example, the memory 75 stores a mild alarm for the heat-exchange amount difference Qd in association with the alarm identification number 1600. The control unit 74 reads the identification number from the alarm received from the abnormality alarm unit 133, and causes the kind of an alarm associated with the read identification number to be displayed on the display unit 72. When a mild alarm related to the heat-exchange amount difference Qd is displayed on the display unit 72, the user can presume that the alarm is output because of contamination of the filter.

Figure 4:
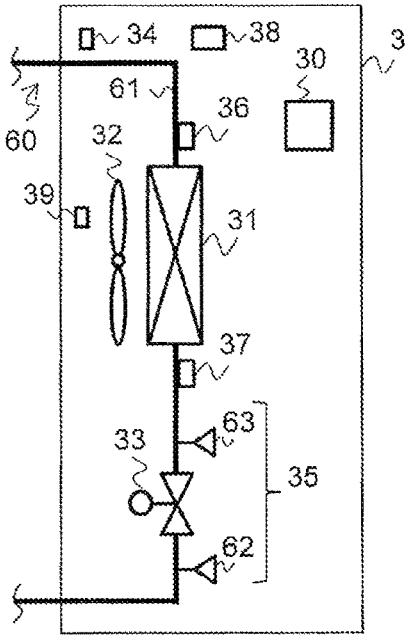
FIG. 4 is a diagram illustrating another example of the configuration of a flow rate detection unit as illustrated in FIG. 1.

Regarding Embodiment 1, the above description is made referring to the case where the flow rate detection unit 35 is a flowmeter. However, the flow rate detection unit is not limited to the flowmeter. FIG. 4 is a diagram illustrating another example of the configuration of the flow rate detection unit as illustrated in FIG. 1. As illustrated in FIG. 4, the flow rate detection unit 35 includes pressure sensors 62 and 63 that detect the pressure of the heat medium that flows through the heat medium pipe 61. The pressure sensor 62 is provided close to the heat medium outlet side of the flow control device 33, and the pressure sensor 63 is provided close to the heat medium inlet side of the flow control device 33. In this case, it suffices that the calculation unit 131 calculates the flow rate FL based on the opening degree of the flow control device 33 and the pressure difference between a detected value obtained by the pressure sensor 62 and a detected value obtained by the pressure sensor 63. It suffices that the determination unit 132 determines whether an abnormality occurs or not in the indoor unit 3 based on the flow rate FL calculated by the calculation unit 131.

Figure 5:
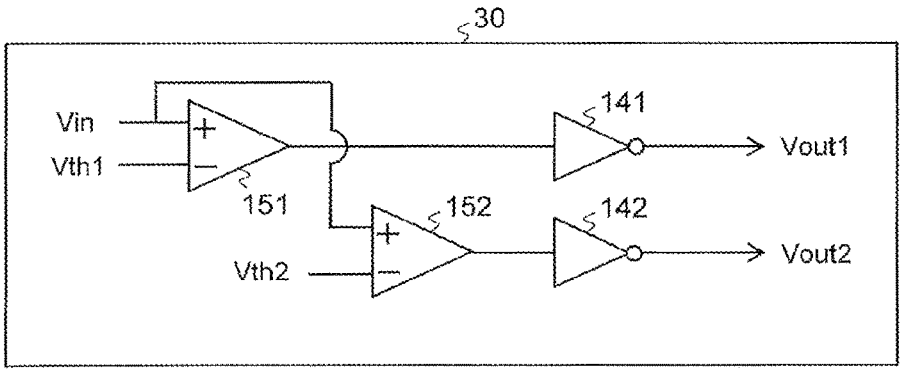
FIG. 5 is a diagram illustrating another example of the configuration of an alarm unit as illustrated in FIG. 1.

The configuration of the alarm unit 30 is not limited to the configuration as illustrated in FIG. 1. The alarm unit 30 may be a device that includes a logic circuit. FIG. 5 is a diagram illustrating another example of the configuration of the alarm unit as illustrated in FIG. 1. FIG. 5 illustrates an example of the configuration in the case where the alarm unit 30 determines whether an abnormality occurs or not in the indoor unit 3 based on the flow rate FL. In this example, it is assumed that the flow rate FL, the first flow rate threshold FLth1, and the second flow rate threshold FLth2 are converted to a voltage Vin, a first threshold voltage Vth1, and a second threshold voltage Vth2, respectively, and are then input to the alarm unit 30.

As illustrated in FIG. 5, the alarm unit 30 includes comparators 151 and 152 and inverter circuits 141 and 142. An output terminal of the comparator 151 is connected to an input terminal of the inverter circuit 141. An output terminal of the comparator 152 is connected to an input terminal of the inverter circuit 142. The voltage Vin is input to a plus terminal of the comparator 151, and the first threshold voltage Vth1 is input to a minus terminal of the comparator 151. The voltage Vin is input to a plus terminal of the comparator 152, and the second threshold voltage Vth2 is input to a minus terminal of the comparator 152.

The comparator 151 compares the voltage Vin with the first threshold voltage Vth1. When the voltage Vin is higher than or equal to the first threshold voltage Vth1, the comparator 151 outputs an on-voltage that is higher than a reference voltage; and when the voltage Vin is less than the first threshold voltage Vth1, the comparator 151 outputs an off-voltage that is less than the reference voltage. When the on-voltage is input from the comparator 151 to the inverter circuit 141, the inverter circuit 141 outputs the off-voltage as a voltage Vout1. When the off-voltage is input from the comparator 151 to the inverter circuit 141, the inverter circuit 141 outputs the on-voltage as the voltage Vout1.

The comparator 152 also compares the voltage Vin with the second threshold voltage Vth2. When the voltage Vin is higher than or equal to the second threshold voltage Vth2, the comparator 152 outputs an on-voltage; and when the voltage Vin is less than the second threshold voltage Vth2, the comparator 152 outputs an off-voltage. When the on-voltage is input from the comparator 152 to the inverter circuit 142, the inverter circuit 142 outputs the off-voltage as a voltage Vout2. When the off-voltage is input from the comparator 152 to the inverter circuit 142, the inverter circuit 142 outputs the on-voltage as the voltage Vout2.

In the alarm unit 30 as illustrated in FIG. 5, when the flow rate FL is higher than or equal to the first flow rate threshold FLth1, both the voltages Vout1 and Vout2 are made to be in the off state. When the flow rate FL is less than the first flow rate threshold FLth1 and is higher than or equal to the second flow rate threshold FLth2, the voltage Vout1 is made to be in the on state, and the voltage Vout2 is made to be in the off state. When the flow rate FL is less than the second flow rate threshold FLth2, both the voltages Vout1 and Vout2 are made to be in the on state. Therefore, also, when the alarm unit 30 as illustrated in FIG. 5 is used, it is possible to determine whether an abnormality occurs or not in the indoor unit 3 based on whether each of the voltages Vout1 and Vout2 is the on state or the off state, and, in the case where an abnormality occurs in the indoor unit 3, it is possible to determine whether an alarm is a mild alarm or a serious alarm.

Furthermore, regarding Embodiment 1, the following description is made referring to the case where the alarm unit 30 outputs an alarm to one or both of the remote control unit 70 and the outdoor unit 2. However, the way of outputting an alarm is not limited to the above way. For example, a light emitting unit not illustrated may be provided at the indoor unit 3, and the alarm unit 30 may notifies the user of occurrence of an abnormality by turning on the light emitting unit. Alternatively, a buzzer not illustrated may be provided at the indoor unit 3, and the alarm unit 30 may notify the user of occurrence of an abnormality by operating the buzzer. Furthermore, the determination by the determination unit 132 may be one or both of the determination based on the flow rate FL and the determination based on the heat-exchange amount difference Qd.

Figure 6:
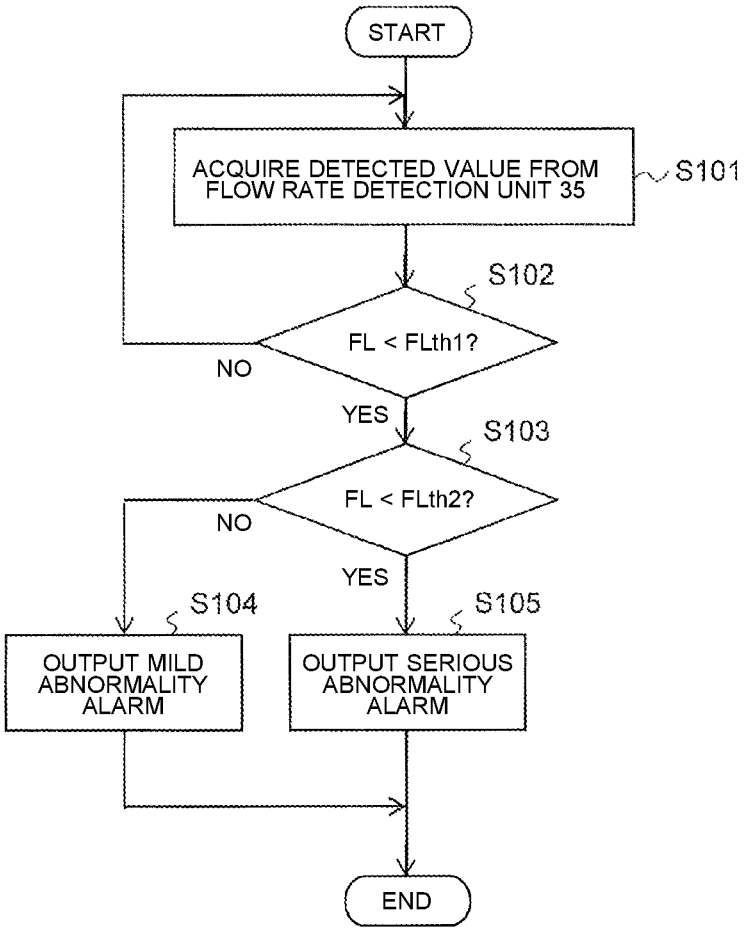
FIG. 6 is a flowchart of an operation procedure of the air-conditioning apparatus as illustrated in FIG. 1.

Next, the operation of the air-conditioning apparatus 1 according to Embodiment 1 will be described. FIG. 6 is a flowchart of an operation procedure of the air-conditioning apparatus as illustrated in FIG. 1. When the operation of the air-conditioning apparatus 1 is started, the alarm unit 30 carries out steps according to the procedure indicated in FIG. 6 at regular intervals. The following description is made referring to the case where the opening degree of the flow control device 33 is constant.

The determination unit 132 acquires a detected value from the flow rate detection unit 35 (step S101). The determination unit 132 compares the flow rate FL that is the detected value from the flow rate detection unit 35, with the first flow rate threshold FLth1 (step S102). When the flow rate FL is higher than or equal to the first flow rate threshold FLth1, the processing returns to step S101. When it is determined as the result of the determination in step S102 that the flow rate FL is less than the first flow rate threshold FLth1, the determination unit 132 compares the flow rate FL with the second flow rate threshold FLth2 (step S103).

When it is determined as the result of the determination in step S103 that the flow rate FL is higher than or equal to the second flow rate threshold FLth2, the abnormality alarm unit 133 outputs a mild alarm to the controller 20 of the outdoor unit 2 and to the remote control unit 70 (step S104). By contrast, when it is determined as the result of the determination in step S103 that the flow rate FL is less than the second flow rate threshold FLth2, the abnormality alarm unit 133 outputs a serious alarm to the controller 20 of the outdoor unit 2 and to the remote control unit 70 (step S105).

When receiving the alarm from the alarm unit 30 in step S104, the remote control unit 70 makes, on the display unit 72, a display indicating that the mild alarm is output. When confirming that the kind of the alarm that is displayed on the display unit 72 is the mild alarm, the user performs maintenance on the indoor unit 3, such as cleaning of the inside of the heat medium pipe 61. When the alarm received from the alarm unit 30 in step S104 is the mild alarm, the controller 20 reduces the rotation speed of the pump 27. When the alarm received from the alarm unit 30 in step S105 is the serious alarm, the controller 20 stops the operation of the pump 27. When receiving the alarm from the alarm unit 30, the remote control unit 70 makes, on the display unit 72, a display indicating that the serious alarm is output. When confirming that the kind of the alarm that is displayed on the display unit 72 is the serious alarm, the user, for example, contacts the maintenance agency of the air-conditioning apparatus 1.

Figure 7:
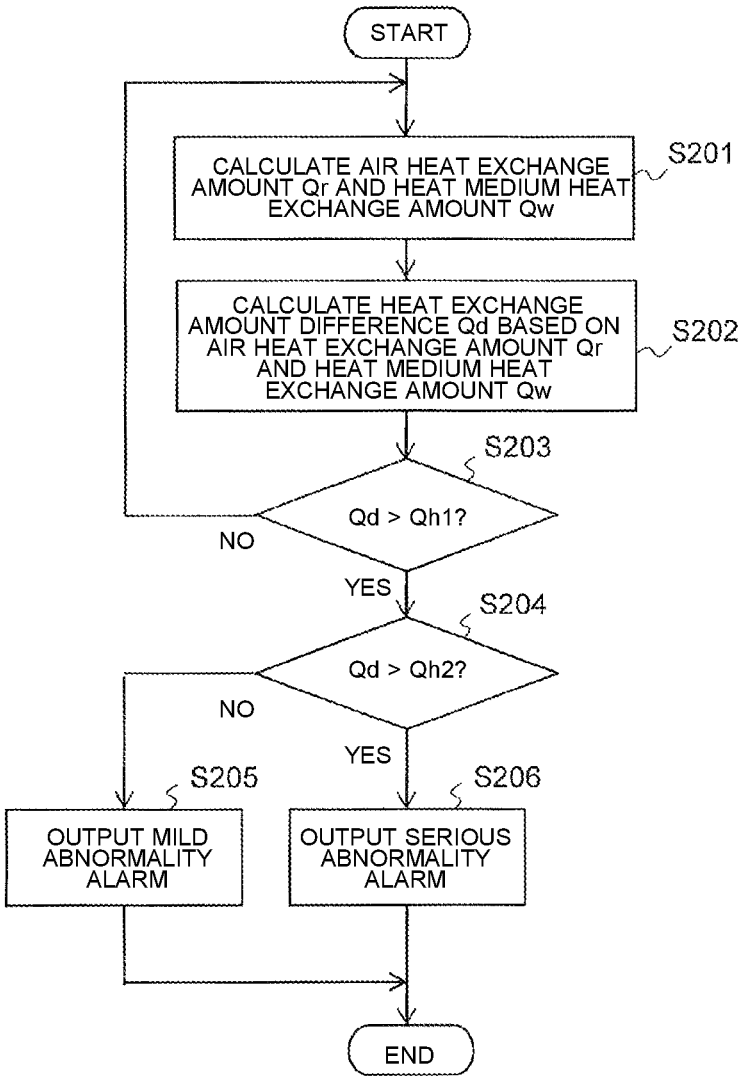
FIG. 7 is a flowchart of another operation procedure of the air-conditioning apparatus as illustrated in FIG. 1.

FIG. 7 is a flowchart of another operation procedure of the air-conditioning apparatus as illustrated in FIG. 1. When the operation of the air-conditioning apparatus 1 is started, the alarm unit 30 carries out steps according to the procedures indicated in FIG. 7 at regular intervals. The calculation unit 131 acquires detected values from the suction temperature sensor 39 and the room temperature sensor 34, and calculates the air heat exchange amount Qr using these detected values. The calculation unit 131 also acquires detected values from the inlet temperature sensor 36 and the outlet temperature sensor 37, and a detected value from the flow rate detection unit 35, and then calculates the heat-medium heat exchange amount Qw using these detected values (step S201). The calculation unit 131 calculates the heat-exchange amount difference Qd that is the difference between the air heat exchange amount Qr and the heat-medium heat exchange amount Qw (step S202).

The determination unit 132 compares the heat-exchange amount difference Qd with the first heat exchange threshold Qth1 (step S203). When the heat-exchange amount difference Qd is less than or equal to the first heat exchange threshold Qth1, the processing returns to step S201. When it is determined as the result of the determination in step S203 that the heat-exchange amount difference Qd is greater than the first heat exchange threshold Qth1, the determination unit 132 compares the heat-exchange amount difference Qd with the second heat exchange threshold Qth2 (step S204).

When it is determined as the result of the determination in step S204 that the heat-exchange amount difference Qd is less than or equal to the second heat exchange threshold Qth2, the abnormality alarm unit 133 outputs a mild alarm to the controller 20 of the outdoor unit 2 and to the remote control unit 70 (step S205). By contrast, when it is determined as the result of the determination in step S204 that the heat-exchange amount difference Qd is greater than the second heat exchange threshold Qth2, the abnormality alarm unit 133 outputs a serious alarm to the controller 20 of the outdoor unit 2 and to the remote control unit 70 (step S206).

When receiving the alarm from the alarm unit 30 in step S205, the remote control unit 70 makes, on the display unit 72, a display indicating that the mild alarm is output. When confirming that the kind of the alarm that is displayed on the display unit 72 is the mild alarm, the user performs maintenance on the indoor unit 3, such as filter cleaning. In step S205, when the alarm received from the alarm unit 30 is the mild alarm, the controller 20 reduces the rotation speed of the pump 27. In step S206, when the alarm received from the alarm unit 30 is the serious alarm, the controller 20 stops the operation of the pump 27. When receiving the alarm from the alarm unit 30, the remote control unit 70 makes, on the display unit 72, a display indicating that the serious alarm is output. When confirming that the kind of the alarm displayed on the display unit 72 is the serious alarm, the user, for example, contacts the maintenance agency of the air-conditioning apparatus 1.

Figure 8:
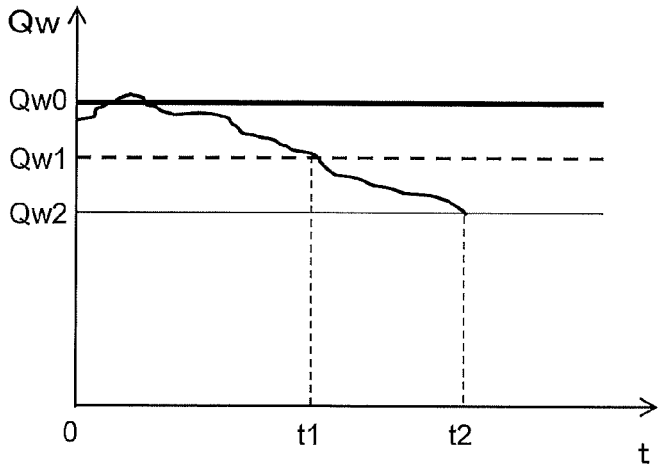
FIG. 8 is a graph of an example of a time-series variation in heat-medium heat exchange amount in a load-side heat exchanger as illustrated in FIG. 1.

An air-conditioning apparatus provided with no alarm unit 30 will be described in comparison with the air-conditioning apparatus 1 according to Embodiment 1. FIG. 8 is a graph of an example of a time-series variation in the heat-medium heat exchange amount in the load-side heat exchanger as illustrated in FIG. 1. In the graph of FIG. 8, the vertical axis represents the heat exchange amount Q, and the horizontal axis represents time t. In FIG. 8, Qw0 is a target value of the heat-medium heat exchange amount Qw, Qw1 is a first heat exchange amount in the case where it is determined that a mild abnormality occurs in the indoor unit 3, and Qw2 is a second heat exchange amount in the case where it is determined that a serious abnormality occurs in the indoor unit 3.

In the case where the alarm unit 30 of Embodiment 1 is not provided in the air-conditioning apparatus, as illustrated in FIG. 8, a heat-medium heat exchange amount Qw calculated by the formula (2) decreases from a value close to the target value Qw0 with the passage of time, and reaches the first heat exchange amount Qw1 at time t1. Even when the heat-medium heat exchange amount Qw decreases to the first heat exchange amount Qw1, an alarm is not given to the user. Even when the heat-medium heat exchange amount Qw decreases to the first heat exchange amount Qw1, an alarm is not given to the user, and the air-conditioning apparatus thus continues to operate. Therefore, the air-conditioning apparatus continues to operate with a low heat exchange efficiency, and power is thus wastefully consumed.

Thereafter, even when time t elapses and the heat-medium heat exchange amount Qw decreases to the second heat exchange amount Qw2 at time t2, an alarm is not given to the user, and the air-conditioning apparatus thus still continues to operate. For example, if a heat medium pipe has a crack, when the air-conditioning apparatus continues to operate, a heat medium may leak therefrom into the indoor space. In this case, the air-conditioning apparatus continues to operate until the user notices the leakage of the heat medium.

By contrast, in the air-conditioning apparatus 1 according to Embodiment 1, as described with reference to FIGS. 6 and 7, the alarm unit 30 outputs a mild alarm or a serious alarm, whereby an abnormality occurring in the indoor unit 3 is not left as it is. Therefore, for example, it is possible to prevent the heat medium from leaking into the indoor space due to damage to the heat medium pipe 61. It is also possible to prevent a failure of the pump 27, and thus also preventing the indoor unit 3 from becoming unable to operate.

Figure 9:
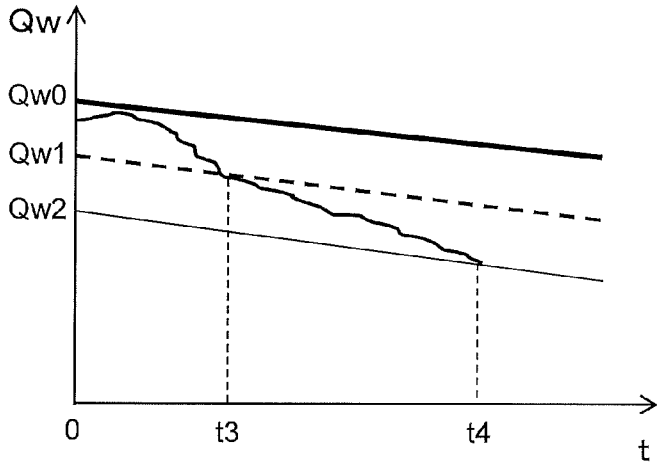
FIG. 9 is a graph of another example of the time-series variation in heat-medium heat exchange amount in the load-side heat exchanger as illustrated in FIG. 1.

Next, the following description is made with respect to a variation in the heat-medium heat exchange amount Qw that depends on aged deterioration of the load-side heat exchanger 31. FIG. 9 is a graph of another example of the time-series variation in the heat-medium heat exchange amount in the load-side heat exchanger as illustrated in FIG. 1. It is known that the refrigeration capacity of the load-side heat exchanger 31 deteriorates with the passage of time. The vertical axis and the horizontal axis of the graph of FIG. 9 are the same as those of FIG. 8. However, time t indicated on the horizontal axis in FIG. 9 is the number of years.

In the graph of FIG. 9, the target value Qw0, the first heat exchange amount Qw1, and the second heat exchange amount Qw2 are set in consideration of the aged deterioration of the load-side heat exchanger 31. The heat-medium heat exchange amount Qw decreases, with the passage of time, from a value dose to the target value Qw0, and reaches the first heat exchange amount Qw1 at time t3. Thereafter, even when time t elapses, and the heat-medium heat exchange amount Qw decreases to the second heat exchange amount Qw2 at time t4, an alarm is not given to the user, and the air-conditioning apparatus continues to operate. As a result, as described with reference to FIG. 8, the air-conditioning apparatus continues to operate with a low heat exchange efficiency, and power is thus wastefully consumed. For example, if a heat medium pipe has a crack, when the air-conditioning apparatus continues to operate, a heat medium may leak therefrom into the indoor space.

Figure 10:
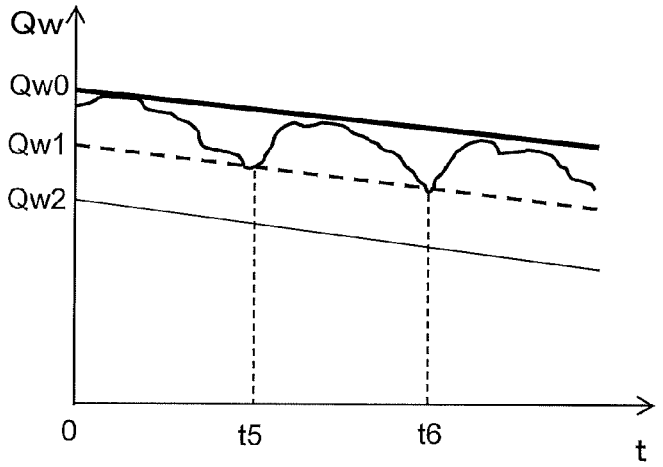
FIG. 10 is a graph illustrating an example of a time-series variation in heat-medium heat exchange amount in the case where filter cleaning is performed each time the alarm unit as illustrated in FIG. 1 outputs a mild alarm.

The following description is made referring to the case in which in the air-conditioning apparatus 1 of Embodiment 1, the load-side heat exchanger 31 deteriorates with the passage of time. FIG. 10 is a graph of an example of a time-series variation in heat-medium heat exchange amount in the case where filter cleaning is performed each time the alarm unit as illustrated in FIG. 1 outputs a mild alarm. It is assumed that the calculation unit 131 calculates the first heat exchange threshold Qth1 and the second heat exchange threshold Qth2 based on the aged deterioration of the load-side heat exchanger 31, and stores the first heat exchange threshold Qth1 and the second heat exchange threshold Qth2 in the memory 91. Specifically, from the time at which the load-side heat exchanger 31 is installed, the calculation unit 131 calculates the first heat exchange threshold Qth1 and the second heat exchange threshold Qth2 at regular intervals based on the aged deterioration of the load-side heat exchanger 31 to update the thresholds stored in the memory 91.

The heat-medium heat exchange amount Qw decreases with the passage of time from a value dose to the target value Qw0, and reaches the first heat exchange amount Qw1 at time t5. At the time t5, the alarm unit 30 outputs a mild alarm to the remote control unit 70. The remote control unit 70 makes, on the display unit 72, a display indicating that the mild alarm is output. The user determines from the display on the display unit 72 that the mild alarm is output because of clogging of the filter, and the user then cleans the filter. After the user cleans the filter, as illustrated in FIG. 10, the heat-medium heat exchange amount Qw returns to a value close to the target value Qw0. Thereafter, when the heat-medium heat exchange amount Qw decreases to the first heat exchange amount Qw1 at time t6, the alarm unit 30 outputs a mild alarm to the remote control unit 70. After confirming that the mild alarm is output, from the display unit 72 of the remote control unit 70, the user cleans the filter. As a result, the heat-medium heat exchange amount Qw returns to a value close to the target value Qw0.

As described above, in Embodiment 1, an alarm is given to the user each time the heat-medium heat exchange amount Qw decreases to the first heat exchange amount Qw1. If the user cleans the filter each time a mild alarm is given to the user, as illustrated in FIG. 10, the air-conditioning apparatus 1 can continue to operate with a higher heat exchange efficiency. Furthermore, the first heat exchange threshold Qth1 and the second heat exchange threshold Qth2 are updated as the deterioration of the load-side heat exchanger 31 progresses with the passage of time. When FIGS. 8 and 9 are compared with each other, it can be seen that the first heat exchange threshold Qth1 that is determined in consideration of the aged deterioration of the load-side heat exchanger 31 decreases with the passage of time. The heat-medium heat exchange amount Qw reaches the first heat exchange amount Qw1 as indicated in FIG. 8 earlier than the first heat exchange amount Qw1 as indicated in FIG. 9, as a result of which the alarm unit 30 erroneously determines that a mild abnormality occurs. Therefore, it is possible to reduce the probability with which it is erroneously determined that a mild abnormality occurs, before the heat-medium heat exchange amount Qw reaches the first heat exchange amount Qw1 as indicated in FIG. 9

The air-conditioning apparatus 1 of Embodiment 1 includes the outdoor unit 2, the indoor unit 3, the flow rate detection unit 35, and the alarm unit 30. The outdoor unit 2 includes the refrigerant circuit 10 in which refrigerant circulates. The indoor unit 3 includes the load-side heat exchanger 31 that causes heat exchange to be performed between air in the indoor space and a heat medium that exchanges heat with the refrigerant. The flow rate detection unit 35 and the alarm unit 30 are provided in the indoor unit 3. The alarm unit 30 includes the determination unit 132 and the abnormality alarm unit 133. The determination unit 132 determines whether an abnormality occurs in the indoor unit 3 or not based on the flow rate FL of the heat medium that is detected by the flow rate detection unit 35. The abnormality alarm unit 133 outputs an alarm when an abnormality occurs in the indoor unit 3.

According to Embodiment 1, the alarm unit 30 determines whether an abnormality occurs in the indoor unit 3 or not based on the flow rate of the heat medium, and the alarm unit 30 outputs an alarm when determining that an abnormality occurs in the indoor unit 3. When the alarm unit 30 outputs an alarm to the remote control unit 70, the user can know from the display on the remote control unit 70 that an abnormality occurs in the indoor unit 3. When the alarm is output, the user will check whether the way of using the air-conditioning apparatus 1 is erroneous or not. For example, the user checks whether the set temperature Ts is excessively high or excessively low. Also, the user checks whether any abnormality occurs in the indoor unit 3 or not. If the user does not know why the abnormality occurs, the user will contact a maintenance agent. As a result, if the user or the maintenance agent can find why the abnormality occurs, the user or the maintenance agent can deal with the abnormality, and can prevent the air-conditioning apparatus 1 from continuing to operate while the indoor unit 3 has the abnormality.

In Embodiment 1, when the alarm unit 30 outputs an alarm to the controller 20 of the outdoor unit 2, the controller 20 may reduce the rotation speed of the pump 27 upon the reception of the alarm. For example, in the case where an abnormality that occurs in the indoor unit 3 is damage to the heat medium pipe 61, the controller 20 may stop the operation of the pump 27 upon the reception of the alarm. When the operation of the pump 27 is stopped, the leakage of a large amount of a heat medium can be prevented.

In Embodiment 1, when the determination unit 132 determines whether an abnormality occur or not based on the flow rate FL of the heat medium, the determination unit 132 may determine whether the degree of the abnormality is serious or mild with reference to the first flow rate threshold FLth1 and the second flow rate threshold FLth2. When a serious alarm is output, the user can presume that the abnormality occurs because of, for example, a failure of the pump 27 or damage to the heat medium pipe 61. When a mild alarm is output, the user can presume that the abnormality occurs because of deposition of a substance contained in the heat medium in the heat medium pipe 61.

In Embodiment 1, the calculation unit 131 may calculate the first flow rate threshold FLth1 and the second flow rate threshold FLth2 from a theoretical value of a flow rate that is determined from the opening degree of the flow control device 33. In this case, the above two thresholds are set to appropriate values depending on the opening degree of the flow control device 33.

In Embodiment 1, the determination unit 132 may determine whether an abnormality occurs or not based on the heat-exchange amount difference Qd that is the difference between the heat-medium heat exchange amount Qw and the air heat exchange amount Qr. In this case, it is possible to determine whether an abnormality occurs or not in heat exchange at the load-side heat exchanger 31. Furthermore, the determination unit 132 may determine whether the degree of the abnormality is serious or mild with reference to the first heat exchange threshold Qth1 and the second heat exchange threshold Qth2. When a serious alarm is output, the user can presume that the abnormality occurs because of, for example, a failure of the load-side fan 32 or a serious deterioration of the load-side heat exchanger 31. When a mild alarm is output, the user can presume that the abnormality occurs because of, for example, an excessively high or excessively low room temperature Tr for the refrigeration capacity of the indoor unit 3, contamination of the filter of the indoor unit 3, or a slight deterioration of the load-side heat exchanger 31.

In Embodiment 1, the calculation unit 131 may calculate the first heat exchange threshold Qth1 and the second heat exchange threshold Qth2 based on the aged deterioration of the load-side heat exchanger 31. In this case, it is possible to reduce the probability with which it is erroneously determined that a mild abnormality occurs, before the heat-exchange amount difference Qd reaches the first heat exchange threshold Qth1 that is set in consideration of the aged deterioration of the load-side heat exchanger 31. It should be noted that the controller 20 may be provided in the indoor unit 3, or may be provided at a place different from the places where the outdoor unit 2 and the indoor unit 3 are provided.

[Modification 1]

Figure 11:
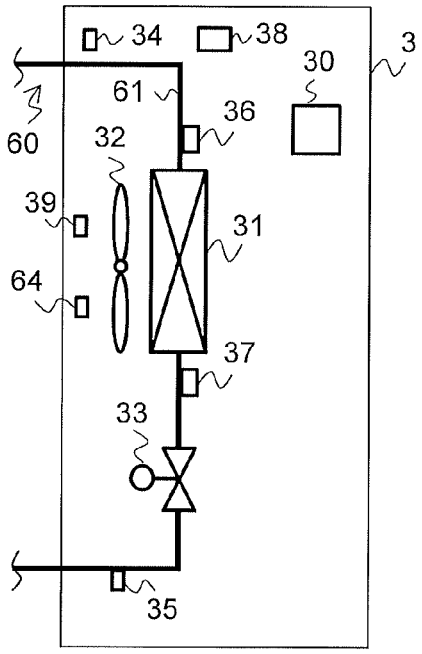
FIG. 11 is a diagram illustrating another example of the configuration of an indoor unit as illustrated in FIG. 1.

In modification 1, to Embodiment 1, the following is added: the determination unit 132 determines why a mild alarm is output. FIG. 11 is a diagram illustrating another example of the configuration of the indoor unit as illustrated in FIG. 1. As compared with the configuration as illustrated in FIG. 1, a suction flow rate sensor 64 is added to the indoor unit 3 as illustrated in FIG. 11, and the suction flow rate sensor 64 detects a suction flow rate AF of air that is sucked into the indoor unit 3.

When determining that a mild abnormality occurs in the indoor unit 3, the determination unit 132 compares the suction flow rate AF with an air flow rate threshold AFth to determine the cause of the mild abnormality. When the suction flow rate AF is less than or equal to the air flow rate threshold AFth, the suction flow rate AF of air is insufficient, and the determination unit 132 thus determines that the abnormality occurs because of clogging of the filter. When the suction flow rate AF is higher than the air flow rate threshold AFth, the suction flow rate AF of air is sufficient, and the determination unit 132 thus determines that the abnormality occurs because of a slight deterioration of the load-side heat exchanger 31.

Figure 12:
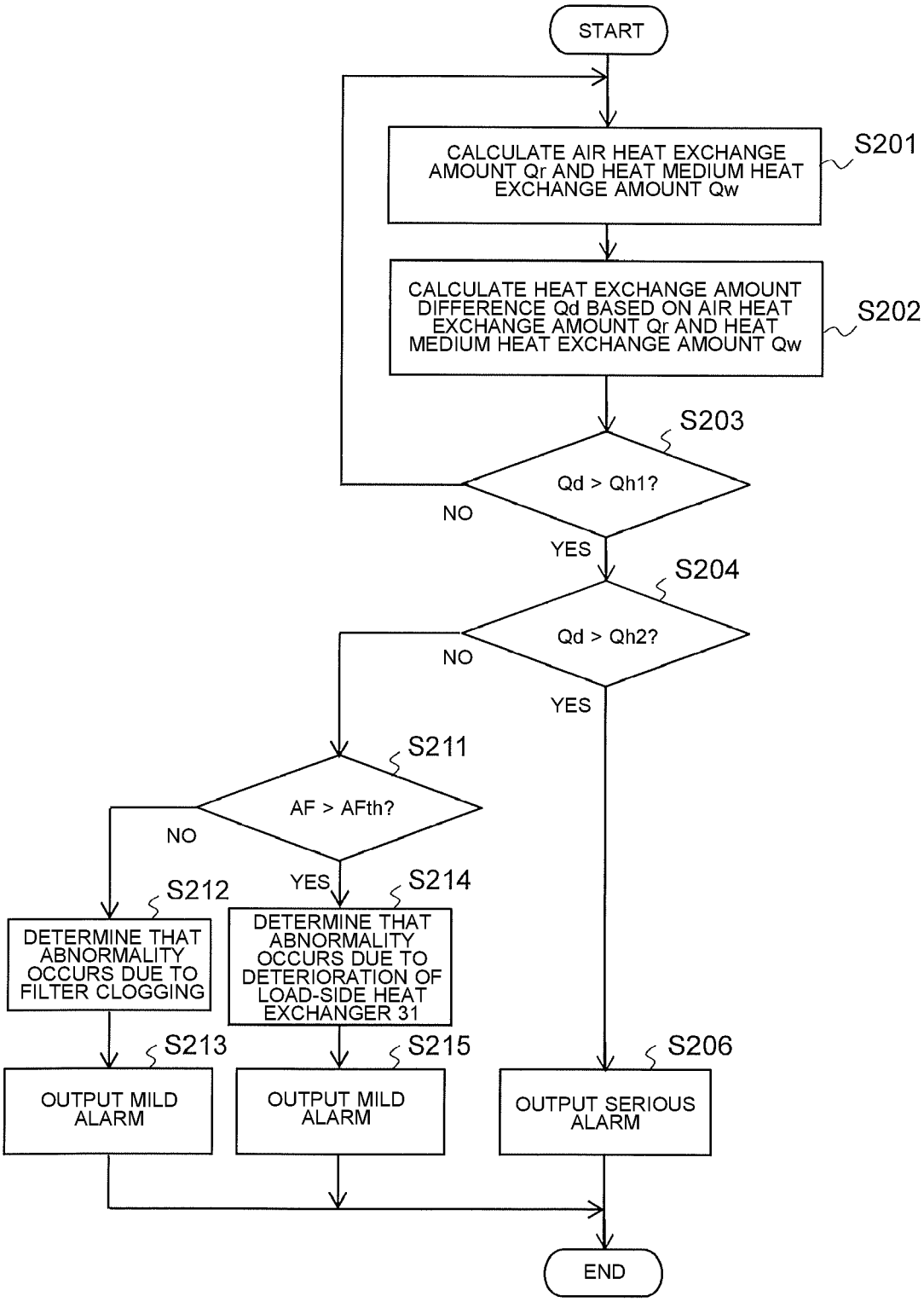
FIG. 12 is a flowchart illustrating the operation procedure of an air-conditioning apparatus of modification 1.

FIG. 12 is a flowchart indicating an operation procedure of the air-conditioning apparatus of modification 1. With respect to modification 1, operations different from the operations indicated in FIG. 7 will be described in detail, and descriptions of operations that are the same as or similar to those indicated in FIG. 17 will be omitted.

When determining as the result of the determination in step S204 that a mild abnormality occurs, the determination unit 132 compares the suction flow rate AF with the air flow rate threshold AFth (step S211). When the suction flow rate AF is less than or equal to the air flow rate threshold AFth, the determination unit 132 determines that the abnormality occurs because of clogging of the filter (step S212). The abnormality alarm unit 133 outputs a mild alarm including information indicating that the abnormality occurs because of clogging of the filter (step S213).

By contrast, when determining as the result of the determination in step S211 that the suction flow rate AF is higher than the air flow rate threshold AFth, the determination unit 132 determines that the abnormality occurs because of a slight deterioration of the load-side heat exchanger 31 (step S214). The abnormality alarm unit 133 outputs a mild alarm including information indicating that the abnormality occurs because of the slight deterioration of the load-side heat exchanger 31 (step S215).

In modification 1, when receiving the mild alarm from the alarm unit 30, the remote control unit 70 makes, on the display unit 72, a display indicating that the mild alarm is output and information indicating the cause of the abnormality in step S213 and S215. As a result, the user can know whether the mild alarm occurs because of clogging of the filter or deterioration of the load-side heat exchanger 31.

[Modification 2]

Figure 13:
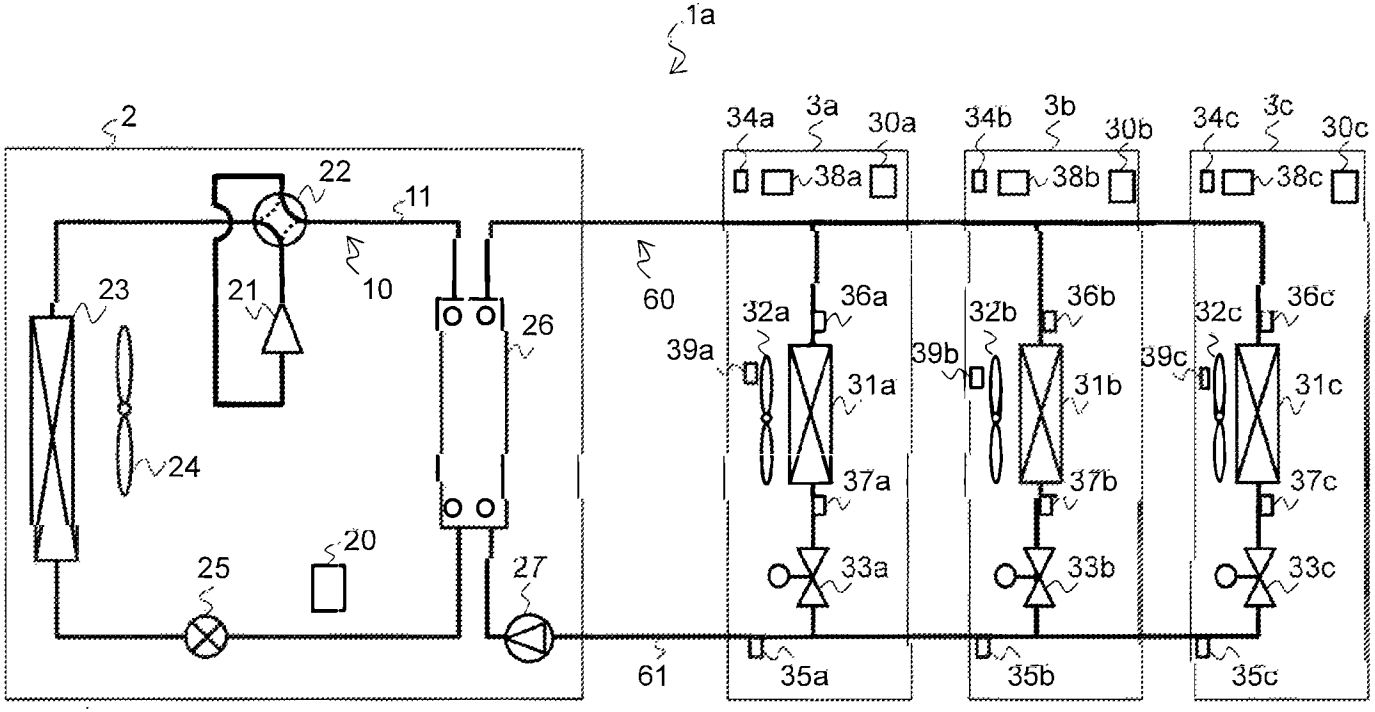
FIG. 13 is a diagram illustrating an example of the configuration of an air-conditioning apparatus of modification 2.

In modification 2, the air-conditioning apparatus 1 as illustrated in FIG. 1 includes a plurality of indoor units 3. FIG. 13 is a diagram illustrating an example of the configuration of an air-conditioning apparatus of modification 2. In the modification, an air-conditioning apparatus 1*a* includes a plurality of indoor units 3*a* to 3*c*. To the indoor units 3*a* to 3*c*, respective unit identifiers are assigned. The indoor units 3*a* to 3*c* have the same configuration as the indoor unit 3 as illustrated in FIG. 1, and their detailed descriptions will thus be omitted.

Load-side heat exchangers 31*a* to 31*c* have the same configuration as the load-side heat exchanger 31. Load-side fans 32*a* to 32*c* have the same configuration as the load-side fan 32. Flow control devices 33*a* to 33*c* have the same configuration as the flow control device 33. Room temperature sensors 34*a* to 34*c* have the same configuration as the room temperature sensor 34. Suction temperature sensors 39*a* to 39*c* have the same configuration as the suction temperature sensor 39. Communication units 38*a* to 38*c* have the same configuration as the communication unit 38.

Flow rate detection units 35*a* to 35*c* have the same configuration as the flow rate detection unit 35. Inlet temperature sensors 36*a* to 36*c* have the same configuration as the inlet temperature sensor 36. Outlet temperature sensors 37*a* to 37*c* have the same configuration as the outlet temperature sensor 37. Alarm units 30*a* to 30*c* have the same configuration as the alarm unit 30. Each of memories 91 of alarm units 30*a* to 30*c* stores the unit identifier of an associated indoor unit. The abnormality alarm unit 133 of each of the alarm units 30*a* to 30*c* outputs an alarm including the unit identifier of the associated indoor unit.

In modification 2, when an abnormality occurs in any of the plurality of indoor units 3*a* to 3*c*, an alarm is output from the alarm unit of the indoor unit in which the abnormality occurs. Each of users of the indoor units 3*a* to 3*c* can check from the remote control unit 70, the kind of an abnormality, when the abnormality occurs in an associated one of the indoor units 3*a* to 3*c* in an indoor space where the user is present. When receiving a mild alarm from any one of the plurality of indoor units 3*a* to 3*c*, the controller 20 reduces the rotation speed of the pump 27. When receiving a serious alarm from any of the indoor units 3*a* to 3*c*, the controller 20 stops the operation of the pump 27.

Figure 14:
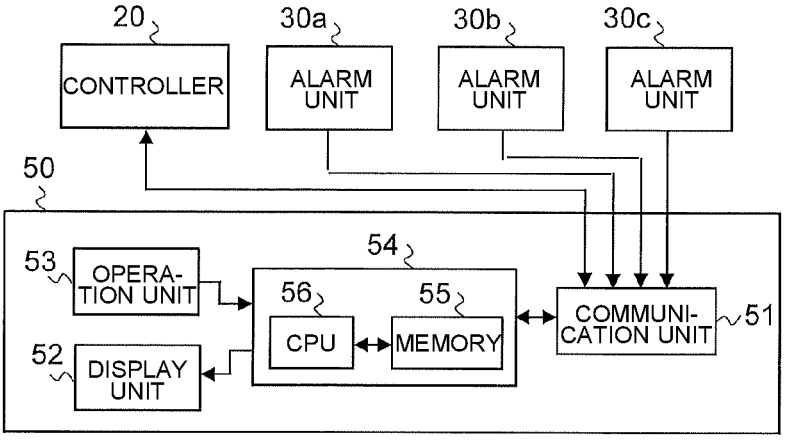
FIG. 14 is a diagram illustrating an example of the configuration of a centralized controller connected to the air-conditioning apparatus as illustrated in FIG. 13.

In modification 2, in the case where the air-conditioning apparatus as illustrated in FIG. 13 is installed in a building, a centralized controller that controls a plurality of indoor units may be provided in the building. FIG. 14 is a diagram illustrating an example of the configuration of the centralized controller that is connected to the air-conditioning apparatus as illustrated in FIG. 13.

A centralized controller 50 includes a communication unit 51, a display unit 52, an operation unit 53, and a control unit 54. The control unit 54 includes a memory 55 that stores a program, and a CPU 56 that executes processing according to the program. The memory 55 stores information on the indoor units 3*a* to 3*c* in association with the unit identifiers. The information on each of the indoor units 3*a* to 3*c* may be, for example, information on an indoor space in the indoor unit is installed and information on the user of the indoor unit.

The manager of the building can set temperatures Tsa to Tsc of a plurality of indoor spaces that are associated with the plurality of indoor units 3*a* to 3*c*, by operating the operation unit 53 of the centralized controller 50. Also, the manager can cause the display unit 52 to display room temperatures Tr of the plurality of indoor spaces that are associated with the plurality of indoor units 3*a* to 3*c*, by operating the operation unit 53 of the centralized controller 50.

In modification 2, when receiving an alarm from any of the plurality of indoor units 3*a* to 3*c*, the control unit 54 causes the display unit 52 to indicate the indoor unit from which the alarm is output and also indicate that the alarm is output. Thus, the manager of the building can specify an indoor unit in which an abnormality occurs, by checking information displayed on the display unit 52.

In modification 2, a plurality of air-conditioning apparatuses 1*a* may be provided in the building. In this case, the centralized controller 50 may be connected to controllers 20 of the plurality of air-conditioning apparatuses 1*a* to collectively manage the indoor units 3*a* to 3*c* of each of the of the air-conditioning apparatuses 1*a*. Furthermore, the above description concerning modification 2 is made with respect to the case where the number of indoor units 3 included in the air-conditioning apparatus 1*a* is three. However, the number of indoor units 3 is not limited to three.

Embodiment 2

An air-conditioning apparatus according to Embodiment 2 includes a relay unit between an outdoor unit and an indoor unit. With respect to Embodiment 2, detailed descriptions of components that are the same as those in Embodiment 1 will be omitted.

Figure 15:
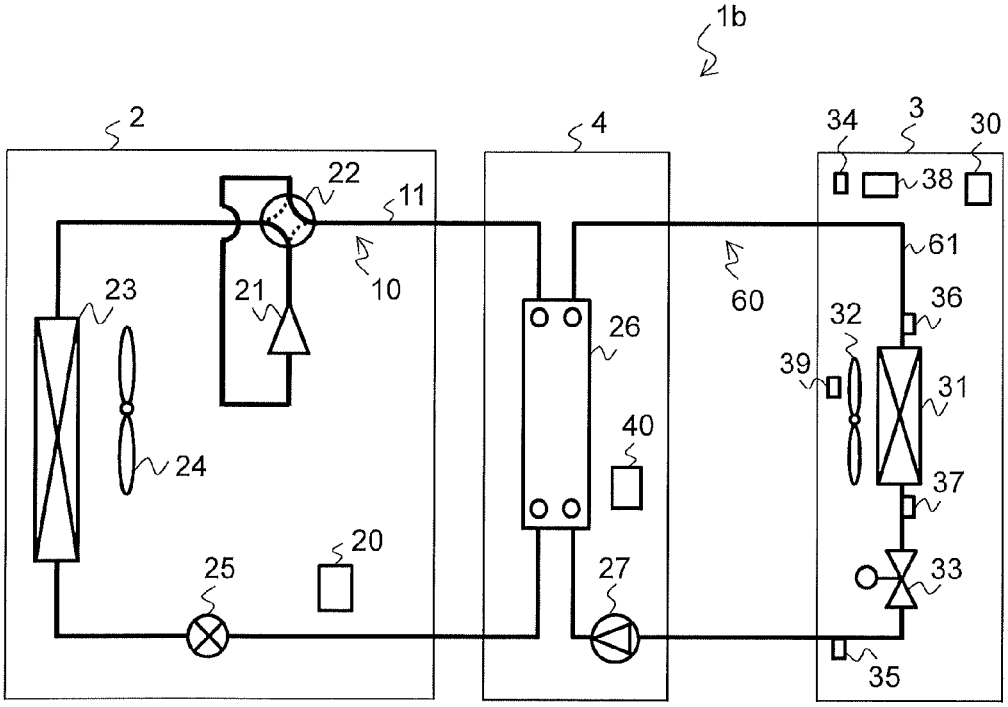
FIG. 15 is a diagram illustrating one example of the configuration of an air-conditioning apparatus according to Embodiment 2 of the present disclosure.

FIG. 15 is a diagram illustrating an example of the configuration of the air-conditioning apparatus according to Embodiment 2 of the present disclosure. An air-conditioning apparatus 1*b* includes the outdoor unit 2, the indoor unit 3, and a relay unit 4 provided between the outdoor unit 2 and the indoor unit 3. The relay unit 4 includes the heat-medium heat exchanger 26 and the pump 27 that are provided in the outdoor unit 2 of the air-conditioning apparatus 1 according to Embodiment 1. The relay unit 4 also includes a control unit 40 that controls the pump 27. Refrigerant circulates between the outdoor unit 2 and the relay unit 4 through the refrigerant circuit 10. A heat medium circulates between the relay unit 4 and the indoor unit 3 through the heat medium circuit 60.

Figure 16:
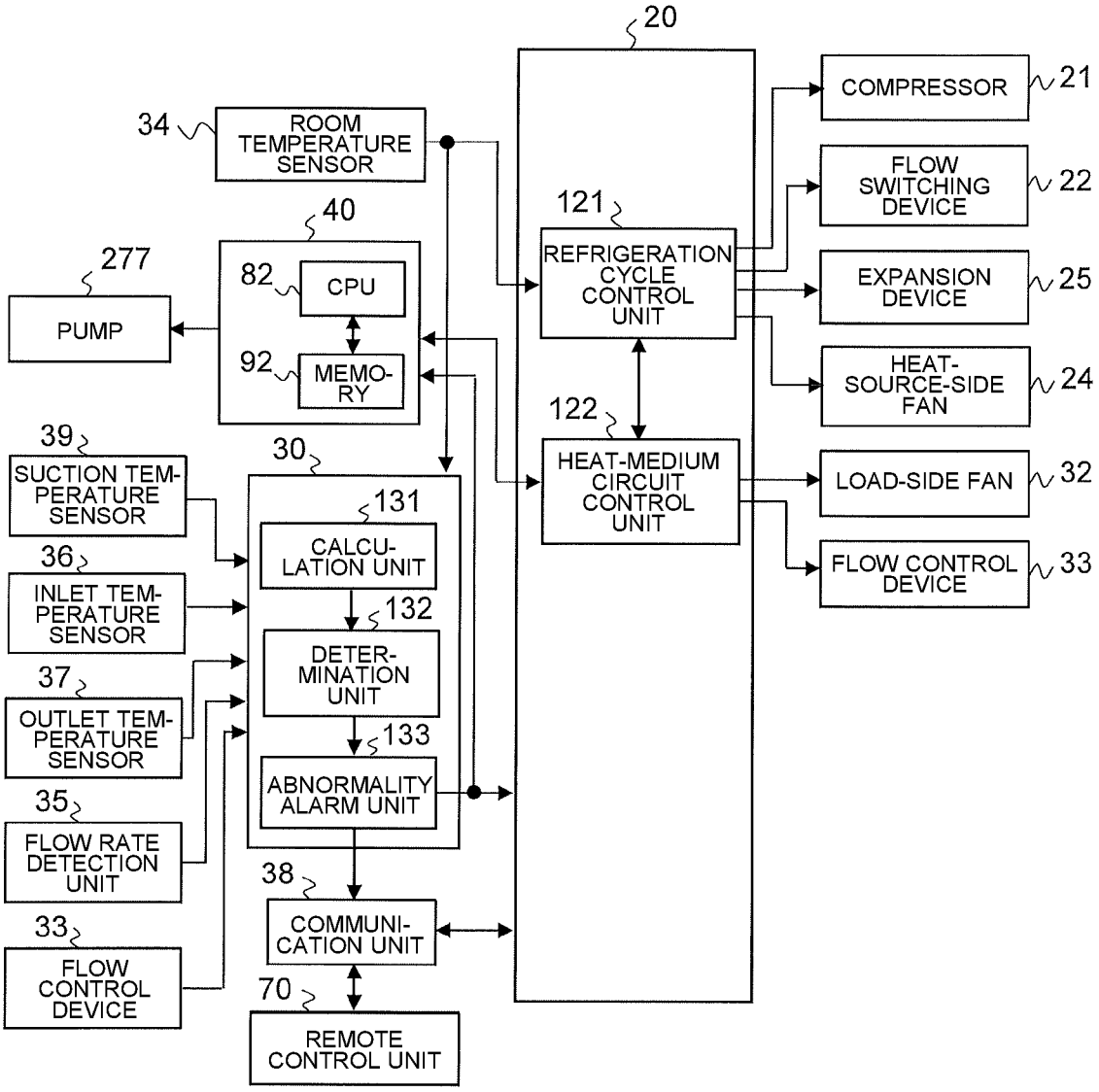
FIG. 16 is a diagram illustrating a configuration related to control of the air-conditioning apparatus illustrated in FIG. 15.

FIG. 16 is a diagram illustrating a configuration related to control by the air-conditioning apparatus as illustrated in FIG. 15. The control unit 40 includes a memory 92 that stores a program, and a CPU 82 that executes processing according to the program. The abnormality alarm unit 133 of the alarm unit 30 outputs an alarm to one or both of the control unit 40 of the relay unit and the remote control unit 70. Also in Embodiment 2, the abnormality alarm unit 133 may output an alarm to the controller 20 of the outdoor unit 2. When the alarm output from the alarm unit 30 is a mild alarm, the control unit 40 reduces the rotation speed of the pump 27. When the alarm output from the alarm unit 30 is a serious alarm, the control unit 40 stops the operation of the pump 27.

As in the air-conditioning apparatus 1*b* of Embodiment 2, also in the case where the pump 27 that causes a heat medium to circulate in the heat medium circuit 60 is provided in the relay unit 4, when the alarm unit 30 outputs an alarm to the relay unit 4, the rotation speed of the pump 27 is reduced. Therefore, for example, in the case where the heat medium pipe 61 is damaged, it is possible to prevent the heat medium from continuously flowing in the heat medium pipe 61, and thus also prevent a large amount of heat medium from leaking from the heat medium pip 61 into the indoor space 1.

Embodiment 3

In Embodiment 3, the air-conditioning apparatus 1 as illustrated in FIG. 1 outputs an alarm to a mobile terminal that the user carries. With respect to Embodiment 3, detailed descriptions of components that are the same as those described regarding Embodiment 1 and/or Embodiment 2 will be omitted. Furthermore, although Embodiment 3 will be described referring to the case where Embodiment 3 is applied to the air-conditioning apparatus 1 as illustrated in FIG. 1, Embodiment 3 may be applied to the air-conditioning apparatus of modification 1, modification 2 or Embodiment 2.

Figure 17:
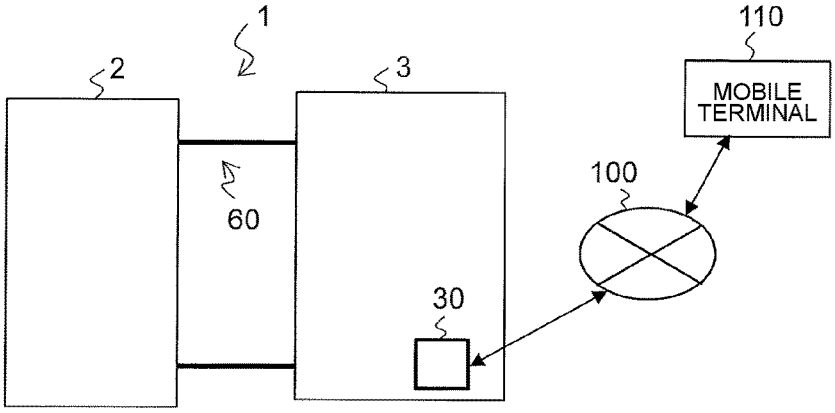
FIG. 17 is a diagram illustrating an example of the configuration of a communication system that includes an air-conditioning apparatus according to Embodiment 3 of the present disclosure.

FIG. 17 is a diagram illustrating an example of the configuration of a communication system that includes an air-conditioning apparatus according to Embodiment 3 of the present disclosure. As illustrated in FIG. 17, the alarm unit 30 is connected to a mobile terminal 110 via a network 100. The network 100 may be the Internet, for example. The mobile terminal 110 is a terminal that a user of the indoor unit 3 carries, for example. However, a person who carries the mobile terminal 110 is not limited to the user. The person who carries the mobile terminal 110 may be a manager of the air-conditioning apparatus 1 or a maintenance agent of the air-conditioning apparatus 1.

Figure 18:
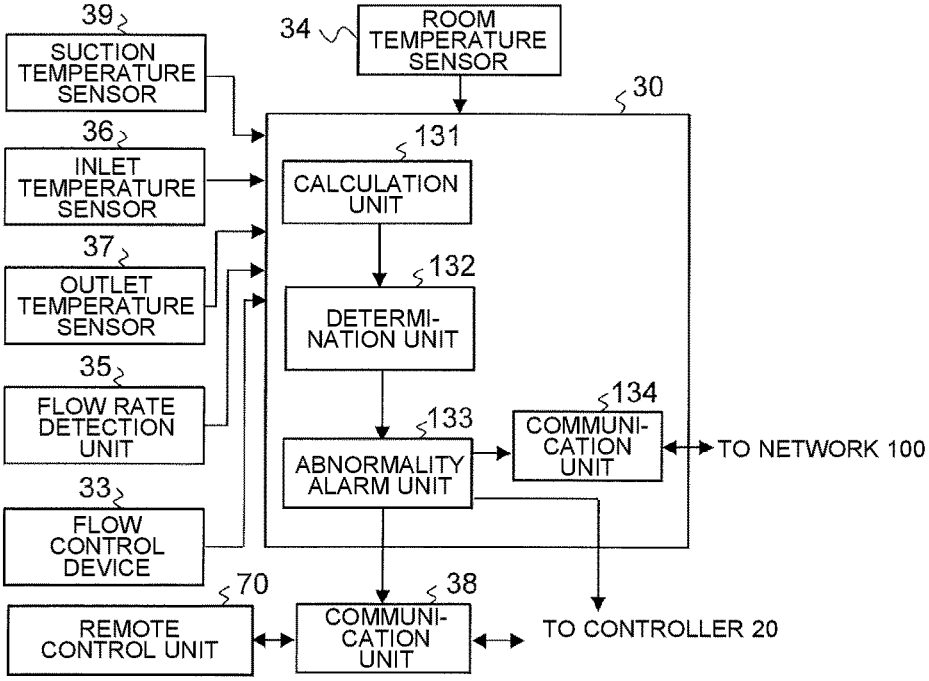
FIG. 18 is a diagram illustrating an example of the configuration of an alarm device according to Embodiment 3 of the present disclosure.

FIG. 18 is a diagram illustrating an example of the configuration of an alarm device according to Embodiment 3 of the present disclosure. The alarm unit 30 as illustrated in FIG. 18 further includes a communication unit 134 connected to the network 100 in addition to the configuration as illustrated in FIG. 1. The communication unit 134 communicates with the mobile terminal 110 according to a predetermined communication protocol. The communication protocol may be a Transmission Control Protocol (TCP)/Internet Protocol (IP), for example.

Figure 19:
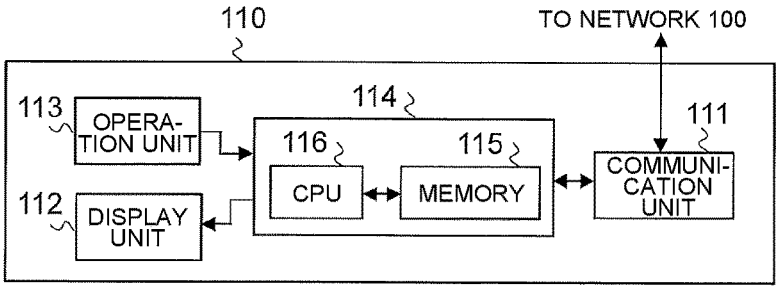
FIG. 19 is a diagram illustrating an example of the configuration of a mobile terminal as illustrated in FIG. 17.

FIG. 19 is a diagram illustrating an example of the configuration of the mobile terminal as illustrated in FIG. 17. The mobile terminal 110 is an information processing device such as a smartphone or a personal digital assistant (PDA). As illustrated in FIG. 19, the mobile terminal 110 includes a communication unit 111, a display unit 112, an operation unit 113, and a control unit 114. The display unit 112 may be a liquid crystal display, for example. The operation unit 113 may be a touch panel, for example. The control unit 114 includes a memory 115 that stores a program, and a CPU 116 that executes processing according to the program. The memory 115 may be a nonvolatile memory, such as a flash memory, for example.

The memory 115 stores the kinds of alarms that are output from the alarm unit 30 and identification numbers that are assigned to respective kinds of alarms, such that the kinds of the alarms are associated with the respective identification numbers. For example, the memory 115 stores a serious alarm for the heat-exchange amount difference Qd such that the serious alarm is associated with an alarm identification number 1400. The control unit 114 reads an identification number from an alarm received from the abnormality alarm unit 133, and causes the display unit 112 to display the kind of the alarm that is associated with the read identification number. When a serious alarm related to the heat-exchange amount difference Qd is displayed on the display unit 112, the user can presume that the alarm is output because of a failure of the load-side fan 32 or a serious deterioration of the load-side heat exchanger 31.

The operation of the air-conditioning apparatus 1 according to Embodiment 3 will be described. When the determination unit 132 of the alarm unit 30 determines that an abnormality occurs in the indoor unit 3, the abnormality alarm unit 133 outputs an alarm to the controller 20 and the remote control unit 70. The abnormality alarm unit 133 also outputs an alarm to the mobile terminal 110 via the communication unit 134 and the network 100. When receiving the alarm from the communication unit 134 via the network 100, the communication unit 111 transmits the received alarm to the control unit 114. When receiving the alarm from the communication unit 111, the control unit 114 causes the display unit 112 to indicate that the alarm is output from the indoor unit 3 and also indicate the kind of the alarm.

According to Embodiment 3, when an abnormality occurs in the indoor unit 3, the alarm unit 30 outputs an alarm to the mobile terminal 110, and the mobile terminal 110 can thus notify the user that the alarm is output from the indoor unit 3. Therefore, even if being out of the user's house while the indoor unit 3 is in operation, the user can know from the display of the mobile terminal 110 that an abnormality occurs in the indoor unit 3. In the case where the mobile terminal 110 gives a serious alarm, the user can immediately contact a maintenance agent even if the user is out of the house.

Furthermore, if the maintenance agent carries the mobile terminal 110, when an abnormality occurs in the air-conditioning apparatus 1, an alarm is automatically output to the mobile terminal 110 of the maintenance agent. Therefore, in this case, it is unnecessary for the user to contact the maintenance agent to notify the agent that the abnormality occurs in the indoor unit 3. In the case where the kind of the alarm given to the maintenance agent via the mobile terminal 110 is a serious alarm, the maintenance agent can immediately make preparations for dealing with the abnormality that occurs in the indoor unit 3 even without contact from the user.

REFERENCE SIGNS LIST

1, 1*a*, 1*b* air-conditioning apparatus, 2 outdoor unit, 3, 3*a* to 3*c* indoor unit, 4 relay unit, 10 refrigerant circuit, 11 refrigerant pipe, 20 controller, 21 compressor, 22 flow switching device, 23 heat-source-side heat exchanger, 24 heat-source-side fan, 25 expansion device, 26 heat-medium heat exchanger, 27 pump, 30, 30*a* to 30*c* alarm unit, 31, 31*a* to 31*c* load-side heat exchanger, 32, 32*a* to 32*c* load-side fan, 33, 33*a* to 33*c* flow control device, 34, 34*a* to 34*c* room temperature sensor, 35, 35*a* to 35*c* flow rate detection unit, 36, 36*a* to 36*c* inlet temperature sensor, 37, 37*a* to 37*c* outlet temperature sensor, 38, 38*a* to 38*c* communication unit, 39, 39*a* to 39*c* suction temperature sensor, 40 control unit, 50 centralized controller, 51 communication unit, 52 display unit, 53 operation unit, 54 control unit, 55 memory, 56 CPU, 60 heat medium circuit, 61 heat medium pipe, 62, 63 pressure sensor, 64 suction flow rate sensor, 70 remote control unit, 71 communication unit, 72 display unit, 73 operation unit, 74 control unit, 75, 90 to 92 memory, 76, 80 to 82 CPU, 100 network, 110 mobile terminal, 111 communication unit, 112 display unit, 113 operation unit, 114 control unit, 115 memory, 116 CPU, 121 refrigeration cycle control unit, 122 heat-medium circuit control unit, 131 calculation unit, 132 determination unit, 133 abnormality alarm unit, 134 communication unit, 141, 142 inverter circuit, 151, 152 comparator.

The invention claimed is:

1. An air-conditioning apparatus comprising:

an outdoor unit including a compressor configured to compress and discharge refrigerant to a refrigerant circuit;

an indoor unit including a load-side heat exchanger configured to cause heat exchange to be performed between air in an air-conditioned space and a heat medium subjected to heat exchange with the refrigerant;

a flow rate detection unit configured to detect a flow rate of the heat medium; and an alarm unit provided in the indoor unit, wherein the alarm unit includes a processing circuit configured to determine whether an abnormality occurs in the indoor unit or not based on the flow rate detected by the flow rate detection unit, output an alarm when determining that the abnormality occurs in the indoor unit, and output a serious alarm when a state of the abnormality is a high-urgency abnormal state in which an operation of the air-conditioning apparatus needs to be immediately stopped, and output a mild alarm when the state of the abnormality is a low-urgency abnormal state, the low-urgency abnormal state ending when maintenance on the air-conditioning apparatus is performed.

2. The air-conditioning apparatus of claim 1, wherein the processing circuit compares the flow rate with a first flow rate threshold and a second flow rate threshold that is less than the first flow rate threshold, and determines that the abnormality occurs, when the flow rate is less than the first flow rate threshold, and the processing circuit outputs the mild alarm, when the flow rate is higher than or equal to the second flow rate threshold and is less than the first flow rate threshold, and outputs the serious alarm, when the flow rate is less than the second flow rate threshold.

3. The air-conditioning apparatus of claim 2, further comprising a flow control device configured to control the flow rate of the heat medium, wherein the processing circuit calculates the first flow rate threshold and the second flow rate threshold based on a theoretical value of the flow rate that is determined depending on an opening degree of the flow control device.

4. The air-conditioning apparatus of claim 1, further comprising:

an inlet temperature sensor configured to detect a temperature of the heat medium at a position close to an inlet of the load-side heat exchanger;

an outlet temperature sensor configured to detect the temperature of the heat medium at a position close to an outlet of the load-side heat exchanger;

a room temperature sensor configured to detect a temperature of the air-conditioned space; and a suction temperature sensor configured to detect a suction temperature of air that is sucked into the indoor unit, wherein the processing circuit calculates a heat-medium heat exchange amount based on the flow rate and a temperature difference between a detected value obtained by the inlet temperature sensor and a detected value obtained by the outlet temperature sensor, calculates an air heat exchange amount based on a detected value obtained by the room temperature sensor and a detected value obtained by the suction temperature sensor, and calculates a heat-exchange amount difference that is a difference between the heat-medium heat exchange amount and the air heat exchange amount, the processing circuit compares the heat-exchange amount difference with a first heat exchange threshold and a second heat exchange threshold that is greater than the first heat exchange threshold, and determines that the abnormality occurs, when the heat-exchange amount difference is greater than the first heat exchange threshold, and the processing circuit outputs the mild alarm, when the heat-exchange amount difference is less than or equal to the second heat exchange threshold and is greater than the first heat exchange threshold, and the abnormality alarm unit outputs the serious alarm, when the heat-exchange amount difference is greater than the second heat exchange threshold.

5. The air-conditioning apparatus of claim 4, wherein the processing circuit calculates the first heat exchange threshold and the second heat exchange threshold based on aged deterioration of the load-side heat exchanger.

6. The air-conditioning apparatus of claim 1, wherein a heat-medium heat exchanger and a pump are provided in the outdoor unit, the heat-medium heat exchanger being connected to the load-side heat exchanger by a heat medium pipe, and configured to cause heat exchange to be performed between the heat medium and the refrigerant, the pump being configured to cause the heat medium to circulate through the heat medium pipe, the processing circuit outputs the alarm to the outdoor unit, and the outdoor unit reduces a rotation speed of the pump upon reception of the alarm from the processing circuit.

7. The air-conditioning apparatus of claim 1, further comprising a relay unit including a heat-medium heat exchanger and a pump, the heat-medium heat exchanger being connected to the load-side heat exchanger by a heat medium pipe, and configured to cause heat exchange to be performed between the heat medium and the refrigerant, the pump being configured to cause the heat medium to circulate through the heat medium pipe, wherein the processing circuit outputs the alarm to the relay unit, and the relay unit reduces a rotation speed of the pump upon reception of the alarm from the processing circuit.

8. The air-conditioning apparatus of claim 1, comprising a plurality of the indoor units, wherein the processing circuit in each of the plurality of the indoor units determines whether the abnormality occurs in the indoor unit or not, and the processing circuit in each of the plurality of the indoor units outputs the alarm when determining that the abnormality occurs in the indoor unit.

9. The air-conditioning apparatus of claim 8, further comprising a centralized controller connected to the alarm units of the plurality of the indoor units, wherein the processing circuit in each of the plurality of the indoor units outputs the alarm to the centralized controller when determining that the abnormality occurs in the indoor unit.

10. The air-conditioning apparatus of claim 1, further comprising a communication unit provided in the indoor unit and configured to communicate with a remote control unit, wherein the processing circuit outputs the alarm to the remote control unit via the communication unit.

11. The air-conditioning apparatus of claim 1, wherein the alarm unit includes a communication unit connected to a network, and the processing circuit outputs the alarm to a mobile terminal connected to the network, via the communication unit.

* * * * *